US009908339B2

(12) United States Patent
Irokawa

(10) Patent No.: US 9,908,339 B2
(45) Date of Patent: Mar. 6, 2018

(54) LIQUID JET HEAD AND LIQUID JET APPARATUS

(71) Applicant: SII Printek Inc., Chiba-shi, Chiba (JP)

(72) Inventor: Daiki Irokawa, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 15/273,763

(22) Filed: Sep. 23, 2016

(65) Prior Publication Data

US 2017/0106663 A1 Apr. 20, 2017

(30) Foreign Application Priority Data

Oct. 16, 2015 (JP) ..... 2015-204914

(51) Int. Cl.
*B41J 2/19* (2006.01)
*B41J 2/14* (2006.01)

(52) U.S. Cl.
CPC ..... *B41J 2/19* (2013.01); *B41J 2/1433* (2013.01); *B41J 2202/12* (2013.01)

(58) Field of Classification Search
CPC ... B41J 2/14; B41J 2/14032; B41J 2/18; B41J 2/19; B41J 2/1433; B41J 2002/14379; B41J 2002/16502; B41J 2202/12
See application file for complete search history.

(56) References Cited

U.S. PATENT DOCUMENTS

2008/0158304 A1 7/2008 Eto ..... 347/65
2011/0242226 A1* 10/2011 Yoshida ..... B41J 2/14201 347/68
2013/0002766 A1* 1/2013 Koseki ..... B41J 2/14209 347/50
2013/0182043 A1* 7/2013 Koseki ..... B41J 2/14209 347/47
2015/0109373 A1 4/2015 Horiguchi ..... 347/68

FOREIGN PATENT DOCUMENTS

GB 2497672 6/2013
JP 2015077737 4/2015

* cited by examiner

*Primary Examiner* — Geoffrey Mruk
*Assistant Examiner* — Scott A Richmond
(74) *Attorney, Agent, or Firm* — Klintworth & Rozenblat IP LLP; Bruce L. Adams

(57) ABSTRACT

A liquid jet head includes an actuator plate having opposite surfaces with ejection grooves arranged on one surface and a return path arranged on the other surface. A spacer plate has one surface on which the actuator plate is positioned and has a side flow path communicating with the ejection grooves. An air bubble retention suppression unit is provided on the spacer plate and suppresses retention of air bubbles in the side flow path.

9 Claims, 11 Drawing Sheets

LIQUID JET HEAD AND LIQUID JET APPARATUS

BACKGROUND

Technical Field

The present invention relates to a liquid jet head and a liquid jet apparatus.

Related Art

Conventionally, ink jet-type liquid jet heads have been used to eject ink droplets onto recording paper or the like to record texts and graphics or eject a liquid material onto the surface of an element substrate to forma functional thin film.

In the ink-jet type, a liquid such as an ink or a liquid material is guided from a liquid tank through a supply tube into a channel (ejection grooves), and a pressure is applied to the liquid charged in the channel to eject the liquid from a nozzle communicating with the channel. Then, at the time of ejecting the liquid, texts and graphics are recorded or a functional thin film of a determined shape is formed while the liquid jet head or the recording medium is moved.

The kinds of liquid jet heads include an edge shoot-type liquid jet head (hereinafter, called simply "edge shoot-type head") and a side shoot-type liquid jet head (hereinafter, called simply "side shoot-type head"), for example.

The edge shoot-type head is structured to have nozzle holes at the end of an ink flow path such that the ink is ejected from the nozzle holes. In the thus configured edge shoot-type head, when air bubbles exist in the ink, the air bubbles may be accumulated in the nozzle holes to interfere with ejection of the ink.

Meanwhile, the side shoot-type head is structured to eject the ink from nozzle holes in the middle of an ink flow path. In the thus structured side shoot-type head, the nozzle holes are provided in the middle of the ink flow path, and therefore air bubbles are unlikely to be retained in the nozzle holes and their surroundings as compared to the edge shoot-type head.

Accordingly, as a particularly preferred edge shoot-type liquid jet head, JP 2015-77737 A discloses a vertical circulation-type liquid jet head (hereinafter, called "vertical circulation-type head").

The vertical circulation-type head includes a nozzle plate with nozzle holes, an actuator plate, ejection grooves provided in one side surface of the actuator plate into which the ink flows, a return path provided in the other side surface of the actuator plate, a circulation channel that has a side flow path communicating with the ejection grooves, the return path, and the nozzle holes.

In the vertical circulation-type head, the distance between the ejection grooves and the return path is shorter than that in the side flow path of the side shoot-type head, and the width of the side flow path is narrow in the direction from the ejection grooves to the return path.

Accordingly, the ink flowing in the circulation channel descends along the ejection grooves, and then turns back immediately and rises in the return path. Therefore, when the flow velocity of the ink is low, the ink may be less easy to flow. That is, air bubbles are hard to be removed from the side flow path and may be retained in the side flow path between the nozzle holes and the ejection grooves.

In the case of using the vertical circulation-type head, the air bubbles in the nozzle holes may move to the side flow path and remain in the side flow path.

Further, the entire side flow path needs to be formed on the actuator plate, thereby complicating the manufacturing process for the actuator plate.

The present invention is devised in light of the foregoing circumstances. An object of the present invention is to provide a liquid jet head and a liquid jet apparatus that can suppress retention of air bubbles in a side flow path positioned between nozzle holes and ejection grooves to suppress accumulation of the air bubbles in the nozzle holes, and can simplify the manufacturing process.

SUMMARY

To solve the above problems, a liquid jet head in one aspect of the present invention includes: an actuator plate configured to have an ejection groove ejecting liquid droplets; a spacer plate configured to have one surface on which the actuator plate is arranged and a side flow path communicating with the ejection groove; a nozzle plate configured to be arranged on the other surface of the spacer plate and have a nozzle hole communicating with the side flow path; a return path configured to be arranged on the surface of the actuator plate opposite to the surface on which the ejection groove is positioned and discharge liquid from the side flow path; and an air bubble retention suppression unit configured to be provided on the spacer plate and suppress retention of air bubbles in the side flow path.

According to a liquid jet head in one aspect of the present invention, providing the air bubble retention suppression unit on the spacer plate makes it possible to simplify the manufacturing process of the actuator plate as compared to the case of providing the air bubble retention suppression unit on the actuator plate.

In addition, providing the air bubble retention suppression unit to suppress retention of air bubbles makes it possible to suppress retention of the air bubbles included in the ink supplied from the ejection grooves to the air bubble retention suppression unit in the side flow path. Accordingly, it is possible to simplify the structure of the actuator plate and suppress accumulation of air bubbles in the nozzle holes.

In addition, providing the air bubble retention suppression unit makes it possible to suppress movement of the air bubbles on the nozzle holes and their surroundings to the side flow path and retention of the air bubbles in the side flow path.

In the liquid jet head, the ejection groove and the return path may extend along a vertical direction, the side flow path may extend along a horizontal direction, the air bubble retention suppression unit may include, above the nozzle hole, a horizontal surface along the horizontal direction and an inclined surface configured to incline with respect to the horizontal surface and widen the side flow path in a direction from the horizontal surface toward an exit side of the side flow path, and a boundary position between the horizontal surface and the inclined surface may be arranged nearer an entry side of the side flow path than a central position of the nozzle hole.

As described above, by arranging the boundary position between the horizontal surface and the inclined surface constituting the air bubble retention suppression unit nearer the entry side of the side flow path than the central position of the nozzle hole and separating the horizontal surface from the central position of the nozzle hole and arranging the inclined surface immediately above the nozzle hole, it is possible to move reliably the air bubbles from the upstream to downstream sides of the side flow path by the buoyant force of the air bubbles. This makes it possible to suppress retention of the air bubbles in the side flow path.

In addition, by including the inclined surface that widens the side flow path from the horizontal surface toward the exit side of the side flow path, it is possible to, even when air bubbles stick to the inclined surface, move the air bubbles along the inclined surface and guide the air bubbles to the return path by the buoyant force of the air bubbles and the flow of the ink from the entry to exit sides of the side flow path.

Accordingly, it is possible to suppress retention of the air bubbles in the side flow path positioned between the nozzle holes and the ejection grooves, thereby suppressing accumulation of the air bubbles in the nozzle holes.

The air bubbles sticking to the inclined surface include air bubbles in the ink flowing into the ejection grooves, air bubbles sticking once to the nozzle holes and their surroundings and then moving to the inclined surface, and the like, for example.

Further, providing the air bubble retention suppression unit on the spacer plate facilitates the formation of the air bubble retention suppression unit as compared to the case where the air bubble retention suppression unit is formed on the actuator plate.

In the liquid jet head, the ejection groove and the return path may extend along a vertical direction, the side flow path may extend along a horizontal direction, and the air bubble retention suppression unit may include, above the nozzle hole, an inclined surface configured to incline with respect to the horizontal direction and widen the side flow path in a direction from an entry side of the side flow path toward an exit side of the side flow path.

With the air bubble retention suppression unit that includes the inclined surface inclined with respect to the horizontal direction and widening the side flow path from the entry side of the side flow path toward the exit side of the side flow path, it is possible to, even when air bubbles stick to the inclined surface, move the air bubbles along the inclined surface and guide the air bubbles to the return path by the buoyant force of the air bubbles and the flow of the ink from the entry to exit sides of the side flow path.

Accordingly, it is possible to suppress retention of the air bubbles in the side flow path positioned between the nozzle holes and the ejection grooves, thereby suppressing accumulation of the air bubbles in the nozzle holes.

The air bubbles sticking to the inclined surface include air bubbles in the ink flowing into the ejection groove, air bubbles sticking once to the nozzle holes and their surroundings and then moving to the inclined surface, and the like, for example.

Further, providing the air bubble retention suppression unit on the spacer plate facilitates the formation of the air bubble retention suppression unit as compared to the case where the air bubble retention suppression unit is formed on the actuator plate.

In the liquid jet head, the ejection groove and the return path may extend along a vertical direction, the side flow path may extend along a horizontal direction, the air bubble retention suppression unit may include, above the nozzle hole, a first inclined surface configured to incline with respect to the horizontal direction and widen the side flow path in a direction from the nozzle hole toward an entry side of the side flow path and a second inclined surface configured to incline with respect to the horizontal direction and widen the side flow path in a direction from the nozzle hole toward an exit side of the side flow path, and a boundary position between the first inclined surface and the second inclined surface may be arranged nearer the entry side of the side flow path than a central position of the nozzle hole.

Since the air bubble retention suppression unit has a first inclined surface that widens the side flow path from the nozzle holes toward the entry side of the side flow path, it is possible to, even when air bubbles stick to the first inclined surface, move the air bubbles to the side flow path positioned on the downstream side of the first inclined surface by the flow of the ink into the ejection grooves and the ink pressure.

In addition, since the air bubble retention suppression unit includes the second inclined surface that widens the side flow path from the nozzle holes toward the exit side of the side flow path and has the boundary position between the first inclined surface and the second inclined surface nearer the entry side of the side flow path than the central position of the nozzle hole, it is possible to, even when air bubbles stick to the second inclined surface, move the air bubbles along the second inclined surface and guide the air bubbles to the return path by the buoyant force of the air bubbles and the flow velocity of the ink flowing from the entry to exit sides of the side flow path.

Accordingly, it is possible to suppress retention of the air bubbles in the side flow path positioned between the nozzle holes and the ejection grooves, thereby suppressing accumulation of the air bubbles in the nozzle holes.

When the air bubbles do not go beyond the boundary position between the first inclined surface and the second inclined surface, the air bubbles rise (move) toward the ejection grooves due to the buoyant force of the air bubbles at the time of stoppage of circulation, thereby suppressing retention of the air bubbles immediately above the nozzle holes.

The air bubbles sticking to the first and second inclined surfaces include air bubbles in the ink flowing into the ejection grooves, air bubbles sticking once to the nozzle holes and their surroundings and then moving to the inclined surface, and the like, for example.

Further, providing the air bubble retention suppression unit on the spacer plate facilitates the formation of the air bubble retention suppression unit as compared to the case where the air bubble retention suppression unit is formed on the actuator plate.

In addition, in the liquid jet head, the ejection groove and the return path may extend along a vertical direction, the side flow path may extend along a horizontal direction, the air bubble retention suppression unit may include, above the nozzle hole, a curved surface configured to protrude in a direction toward the nozzle plate, and a lowest point on the curved surface may be arranged nearer an entry side of the side flow path than a central position of the nozzle hole.

By providing the air bubble retention suppression unit with the curved surface projecting toward the nozzle plate and arranging the lowest point on the curved surface nearer the entry side of the side flow path than the central position of the nozzle hole, it is possible to, even when air bubbles stick to the curved surface arranged nearer the ejection grooves than the lowest point, move the air bubbles to the curved surface positioned nearer the return path than the lowest point by the flow of the ink into the ejection grooves and the buoyant force of the air bubbles.

In addition, it is possible to move the air bubbles on the curved surface positioned nearer the return path than the lowest point along the curved surface positioned nearer the return path than the lowest point and guide the air bubbles to the return path by the buoyant force of the air bubbles and the flow of the ink from the entry to exit sides of the side flow path.

Accordingly, it is possible to suppress retention of the air bubbles in the side flow path positioned between the nozzle holes and the ejection grooves, thereby suppressing accumulation of the air bubbles in the nozzle holes.

The air bubbles sticking to the curved surface include air bubbles in the ink flowing into the ejection grooves, air bubbles sticking once to the nozzle holes and their surroundings and then moving to the inclined surface, and the like, for example.

Further, providing the air bubble retention suppression unit on the spacer plate facilitates the formation of the air bubble retention suppression unit as compared to the case where the air bubble retention suppression unit is formed on the actuator plate.

In addition, in the liquid jet head, the ejection groove and the return path may extend along a vertical direction, the side flow path may extend along a horizontal direction, and the air bubble retention suppression unit may include, above the nozzle hole, at least one step portion configured to widen the side flow path in a direction from an entry side of the side flow path toward an exit side of the side flow path.

By providing the air bubble retention suppression unit that includes at least one step portion widening the side flow path in the direction from the entry side of the side flow path toward the exit side of the side flow path, it is possible to, even when air bubbles stick to the lower end of the air bubble retention suppression unit, move the air bubbles in the direction toward the return path and guide the air bubbles to the return path by the buoyant force of the air bubbles and the flow of the ink moving from the entry to exit sides of the side flow path.

Accordingly, it is possible to suppress retention of the air bubbles in the side flow path positioned between the nozzle holes and the ejection grooves, thereby suppressing accumulation of the air bubbles in the nozzle holes.

The air bubbles include air bubbles in the ink flowing into the ejection grooves, air bubbles sticking once to the nozzle holes and their surroundings and then moving to the inclined surface, and the like, for example.

Further, providing the air bubble retention suppression unit on the spacer plate facilitates the formation of the air bubble retention suppression unit as compared to the case where the air bubble retention suppression unit is formed on the actuator plate.

In addition, in the liquid jet head, the air bubble retention suppression unit may be a flow velocity increase part that is arranged at an entry side of the side flow path and increases a flow velocity of the liquid more at the entry side of the side flow path than an exit side of the side flow path, and the size of a flow path opening of the flow velocity increase part may be smaller than the size of a flow path opening at the exit side of the side flow path.

By providing the thus configured flow velocity increase part to increase the flow velocity more at the entry side of the side flow path than the exit side of the side flow path, it is possible to suppress retention of the air bubbles in the side flow path positioned between the nozzle holes and the ejection grooves, thereby suppressing accumulation of the air bubbles in the nozzle holes.

Further, providing the air bubble retention suppression unit on the spacer plate facilitates the formation of the air bubble retention suppression unit as compared to the case where the air bubble retention suppression unit is formed on the actuator plate.

In addition, in the liquid jet head, the flow velocity increase part may include a first portion configured to be arranged nearer the entry side of the side flow path than a formation position of the nozzle hole and be formed from the spacer plate arranged on the nozzle plate, and by means of the first portion, the size of the flow path opening of the flow velocity increase part may be smaller than the size of the flow path opening portion at the exit side of the side flow path.

According to this configuration, by the simple structure, it is possible to decrease the flow path cross section area at the entry side of the side flow path and increase the flow path cross section area of the side flow path at the exit side as compared to the flow path cross section area at the entry side of the side flow path.

In addition, by increasing the flow path cross section area at the exit side of the side flow path as compared to the flow path cross section area at the entry side of the side flow path, it is possible to increase the flow velocity at the entry side of the side flow path, thereby guiding the air bubbles positioned in the side flow path to the return path.

Accordingly, it is possible to suppress retention of the air bubbles in the side flow path positioned between the nozzle holes and the ejection grooves, thereby suppressing accumulation of the air bubbles in the nozzle holes.

A liquid jet apparatus in one aspect of the present invention may include: the liquid jet head; and a movement mechanism configured to relatively move the liquid jet head and a recording medium.

According to the liquid jet apparatus in one aspect of the present invention, it is possible to suppress accumulation of air bubbles in the nozzle holes by including the liquid jet head and the movement mechanism moving relatively the liquid jet head and the recording medium. This makes it possible to eject ink droplets from the nozzle holes and produce prints in a favorable state.

According to the present invention, it is possible to suppress retention of air bubbles in the side flow path positioned between the nozzle holes and the ejection grooves, thereby suppressing accumulation of the air bubbles in the nozzle holes, and simplify the manufacturing process.

DETAILED DESCRIPTION

Figure 1:
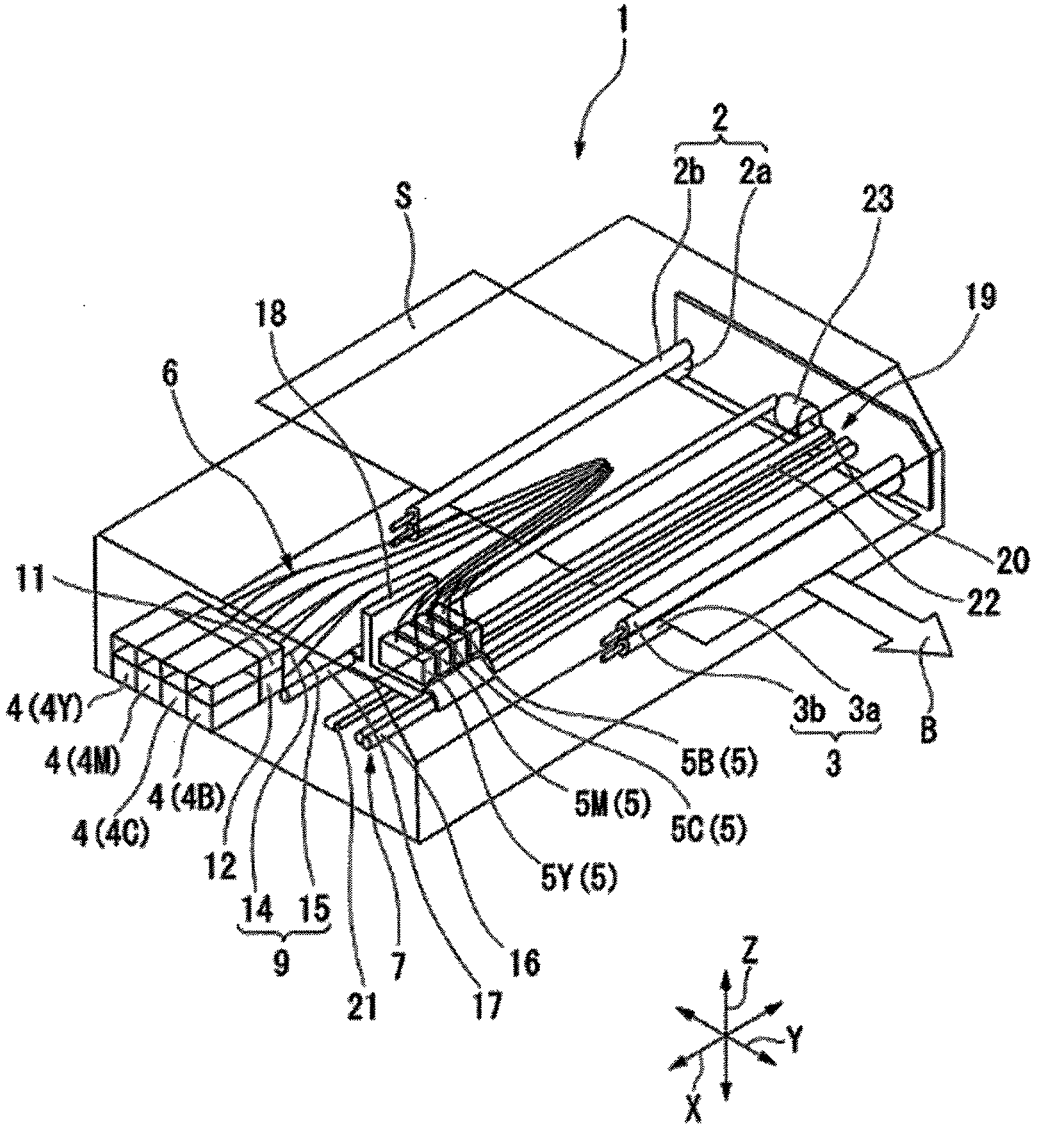
FIG. 1 is a schematic perspective view of a liquid jet apparatus according to a first embodiment of the present invention.

Embodiments to which the present invention is applied will be explained below in detail with reference to the drawings. The drawings used in the following explanation are intended to describe configurations of embodiments of the present invention. The sizes, thicknesses, dimensions, and the like of the components illustrated in the drawings may be different from actual dimensions of a liquid jet head and a liquid jet apparatus.

First Embodiment

FIG. 1 is a schematic perspective view of a liquid jet apparatus 1 according to a first embodiment of the present invention. In FIG. 1, the scales of the members are changed as appropriate for the sake of understandability.

<Liquid Jet Apparatus>

Referring to FIG. 1, a liquid jet apparatus 1 in a first embodiment includes: a pair of conveyance means 2 and 3 that conveys a recording medium S such as paper; an ink tank 4 that stores an ink, a liquid jet head 5 as an ink-jet head ejecting ink droplets onto the recording medium S; an ink circulation means 6 that circulates the ink between the ink tank 4 and the liquid jet head 5; and a scanning means (movement mechanism) 7 that moves the liquid jet head 5 for scanning in a direction (direction along the width of the recording medium S (hereinafter, called X direction) orthogonal to a direction of conveyance of the recording medium S (hereinafter, called Y direction).

Z direction (vertical direction) in the drawing indicates a height direction orthogonal to the Y direction and the X direction.

The conveyance means 2 includes a grid roller 2*a* extended in the X direction, a pinch roller 2*b* extended in parallel to the grid roller 2*a*, and a drive mechanism such as a motor (not illustrated) rotating axially the grid roller 2*a*.

Similarly, the conveyance means 3 includes a grid roller 3*a* extended in the X direction, a pinch roller 3*b* extended in parallel to the grid roller 3*a*, and a drive mechanism such as a motor (not illustrated) rotating axially the grid roller 3*a*.

The ink tank 4 has ink tanks 4Y, 4M, 4C, and 4B for four color inks of yellow, magenta, cyan, and black aligned in the Y direction, for example.

Figure 2:
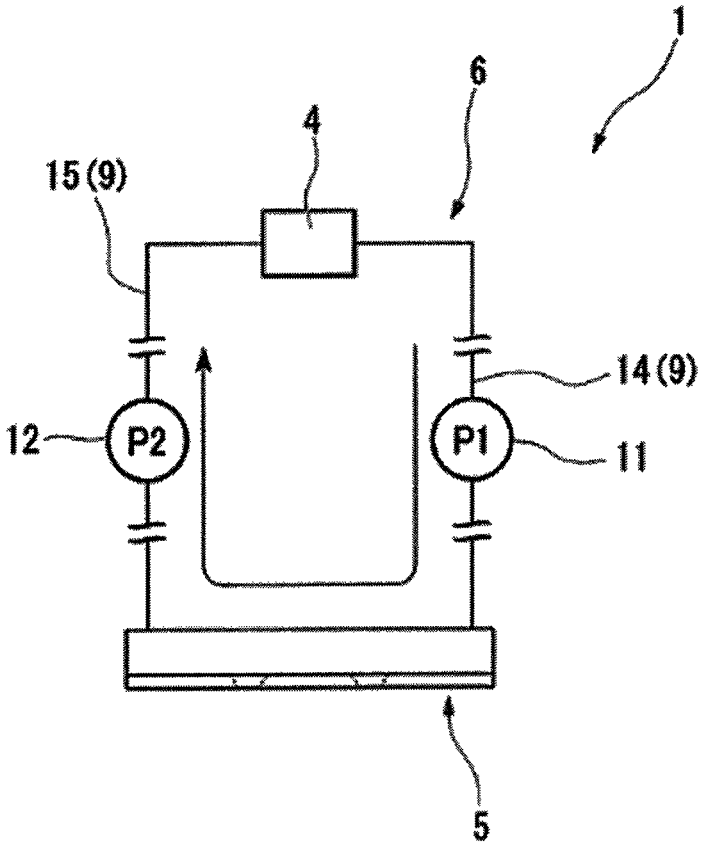
FIG. 2 is a schematic configuration diagram of a liquid jet head and an ink circulation means illustrated in FIG. 1.

FIG. 2 is a schematic configuration diagram of the liquid jet head 5 and the ink circulation means 6 illustrated in FIG. 1.

As illustrated in FIGS. 1 and 2, the ink circulation means 6 includes a circulation flow path 9, a pressure pump 11, and a suction pump 12.

The circulation flow path 9 has an ink supply pipe 14 that supplies an ink to the liquid jet head 5 and an ink discharge pipe 15 that discharges the ink from the liquid jet head 5. The ink supply pipe 14 and the ink discharge pipe 15 are composed of flexible hoses or the like responsible to the operation of the scanning means 7 supporting 5.

The pressure pump 11 is connected to the ink supply pipe 14. The pressure pump 11 pressurizes the inside of the ink supply pipe 14 to send the ink to the liquid jet head 5 via the ink supply pipe 14. Accordingly, the ink supply pipe 14 is under positive pressure relative to the liquid jet head 5.

The suction pump 12 is connected to the ink discharge pipe 15. The suction pump 12 depressurizes the inside of the ink discharge pipe 15 to suck the ink from the liquid jet head 5. Accordingly, the ink discharge pipe 15 is under negative pressure relative to the liquid jet head 5. In addition, the ink can circulate between the liquid jet head 5 and the ink tank 4 via the circulation flow path 9 by driving of the pressure pump 11 and the suction pump 12.

As illustrated in FIG. 1, the scanning means 7 includes a pair of guide rails 16 and 17 extended in the X direction, a carriage 18 movably supported by the pair of guide rails 16 and 17, and a drive mechanism 19 that moves the carriage 18 in the X direction.

The drive mechanism 19 includes a pair of pulleys 20 and 21 arranged between the pair of guide rails 16 and 17, and an endless belt 22 wound between the pair of pulleys 20 and 21, and a drive motor 23 that drives rotationally the one pulley 20.

The pair of pulleys 20 and 21 is arranged between both ends of the pair of guide rails 16 and 17. The endless belt 22 is arranged between the pair of guide rails 16 and 17. The carriage 18 is coupled to the endless belt 22.

In the carriage 18, as a plurality of liquid jet heads 5, liquid jet heads 5Y, 5M, 5C, and 5B for four color inks of yellow, magenta, cyan, and black are mounted and aligned in the X direction.

The conveyance means 2 and 3 and the scanning means 7 described above constitute the movement mechanism that moves relatively the liquid jet head 5 and the recording medium S.

<Head Chip>

Figure 3:
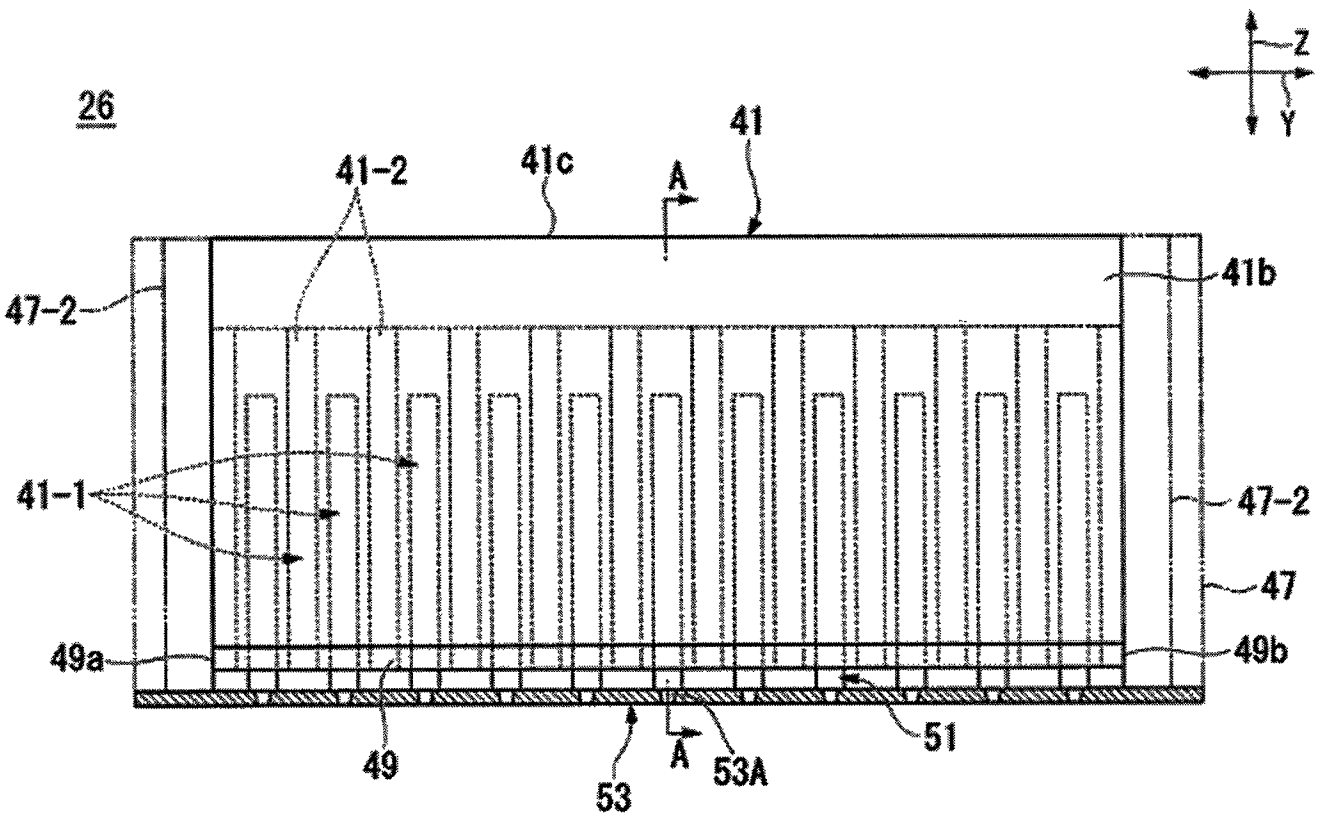
FIG. 3 is a schematic plane view of a head chip in which a plate is removed from constituent elements of the head chip constituting the liquid jet head illustrated in FIG. 2 seen from a plate arrangement position.
Figure 4:
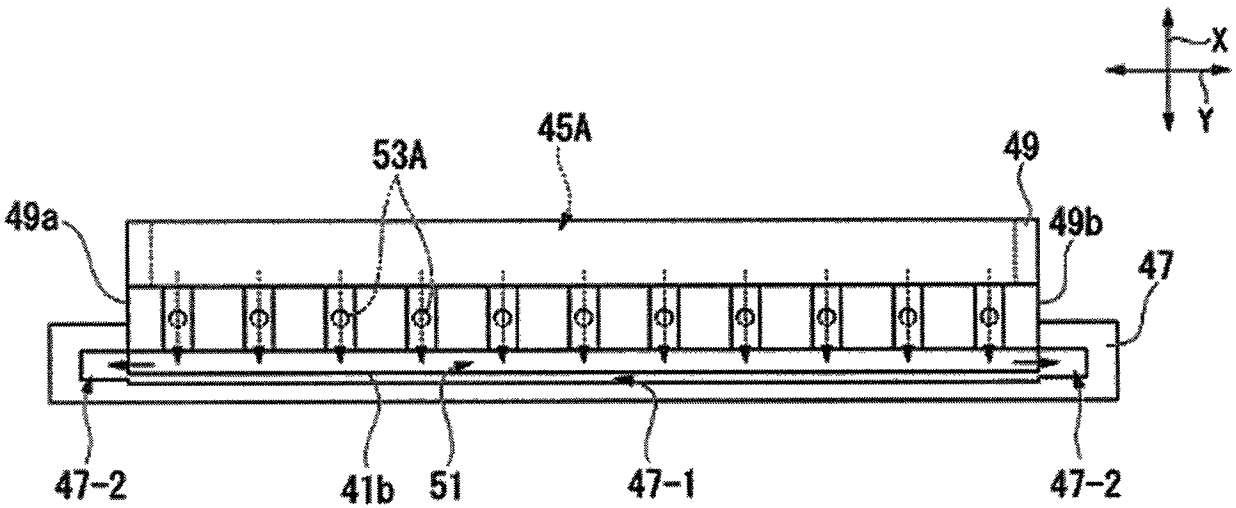
FIG. 4 is a plane view of a structure body in which a nozzle plate is removed from the head chip illustrated in FIG. 3 seen from arrangement position of the nozzle plate.
Figure 5:
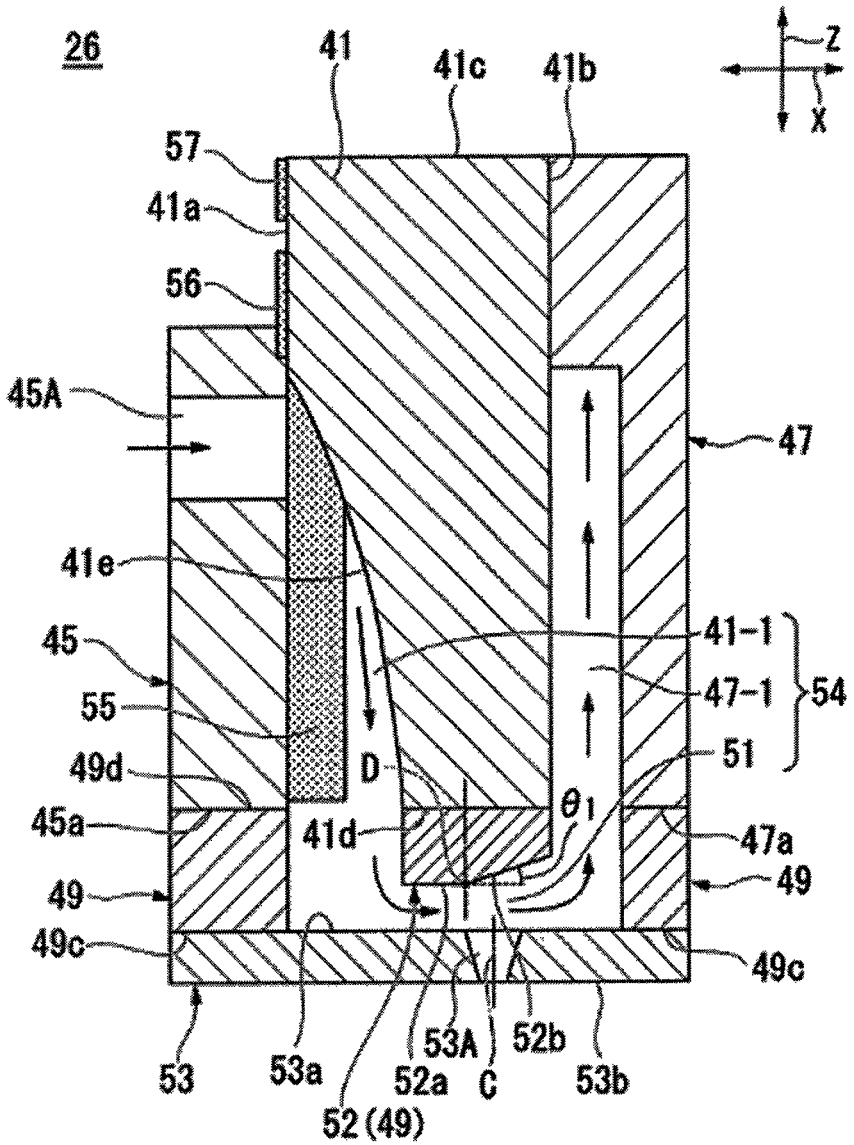
FIG. 5 is a cross-sectional view of the head chip illustrated in FIG. 3 taken along line A-A.

FIG. 3 is a schematic plane view of a head chip 26 in which a plate is removed from constituent elements of the head chip 26 constituting the liquid jet head 5 illustrated in FIG. 2 seen from a plate arrangement position. FIG. 4 is a plane view of a structure body in which a nozzle plate 53 is removed from the head chip 26 illustrated in FIG. 3 seen from arrangement position of the nozzle plate 53. FIG. 5 is a cross-sectional view of the head chip 26 illustrated in FIG. 3 taken along line A-A.

Arrows in FIGS. 4 and 5 indicate directions in which the ink flows. In FIGS. 3 to 5, the same components are given the same reference signs. In addition, FIGS. 3 to 5 illustrate a vertical circulation-type head chip as an example of head chip.

Referring to FIGS. 3 to 5, the head chip 26 has an actuator plate 41, a cover plate 45, a plate 47, a spacer plate 49, a nozzle plate 53, a circulation channel 54, common electrodes 55, a common terminal 56, individual terminals 57, and active electrodes (not illustrated).

The actuator plate 41 has flat side surfaces 41*a* and 41*b*, a flat upper end surface 41*c*, a flat lower end surface 41*d*, a plurality of ejection grooves 41-1, and a plurality of non-ejection grooves 41-2.

The side surface 41*a* is a surface on which the cover plate 45 is placed. The side surface 41*b* is on the opposite side of the side surface 41*a* and the plate 47 is placed on the side surface 41*b*.

The ejection grooves 41-1 and the non-ejection grooves 41-2 are alternately arranged in the Y direction. Accordingly, a side wall formed by the actuator plate 41 is arranged in the Y direction between the ejection grooves 41-1 and the non-ejection grooves 41-2.

The ejection grooves 41-1 are grooves into which the ink is supplied and are provided on the one side surface 41*a* of the actuator plate 41. Some of the ejection grooves 41-1 are provided on the spacer plate 49. Accordingly, the ejection grooves 41-1 communicate with a side flow path 51 described later.

Some of the ejection grooves 41-1 are defined by a curve surface 41*e* formed on the actuator plate 41 and the spacer plate 49. The curve surface 41*e* is formed to separate from the cover plate 45 arranged on the side surface 41*a* in a direction from the upper end surface 41*c* toward the lower end surface 41*d*. The curve surface 41*e* can be formed by a dicing blade, for example.

The ejection grooves 41-1 are provided from an inner surface 53*a* of the nozzle plate 53 arranged under the cover plate 45 via the spacer plate 49 to the position above an upper liquid chamber 45A. The ejection grooves 41-1 extend in the Z direction (vertical direction).

The non-ejection grooves 41-2 are penetration grooves that range from the upper end surface 41*c* to the lower end surface 41*d* of the actuator plate 41 and extend in the Z direction (vertical direction). The non-ejection grooves 41-2 are grooves into which no ink is supplied.

Unlike the ejection grooves 41-1, the non-ejection grooves 41-2 do not communicate with the side flow path 51. The non-ejection grooves 41-2 can be formed by a dicing blade, for example.

The material for the actuator plate 41 can be a PZT ceramic or any other piezoelectric material, for example.

The actuator plate 41 may be subjected to polarization with respect to the vertical direction of the side surface 41*a*, for example. In this case, the actuator plate 41 can be a chevron-type piezoelectric substrate in which piezoelectric layers (not illustrated) subjected to polarization in the direction vertical to the side surface 41*a* and piezoelectric layers (not illustrated) supplied to polarization in the opposite direction are stacked.

The cover plate 45 is joined to the side surface 41*a* of the actuator plate 41. The cover plate 45 has the upper liquid chamber 45A communicating with the ejection grooves 41-1. The upper liquid chamber 45A serves as an ink introduction opening.

The material for the cover plate 45 can be a PZT ceramic or any other ceramic, a metal, a glass material, a plastic, or the like, for example.

The plate 47 is joined to the side surface 41*b* of the actuator plate 41. The plate 47 has a return path 47-1 provided on the side surface 41*b* side of the actuator plate 41 and a flow path 47-2.

The return path 47-1 is formed by making a concave in a portion of the plate 47 positioned on the side surface 41*b* side. The return path 47-1 is arranged from the inner surface 53*a* of the nozzle plate 53 arranged under the plate 47 to the upper part via the spacer plate 49.

The plate 47 projects from two side surfaces 49*a* and 49*b* of the spacer plate 49 orthogonal to the Y direction toward the outside (Y direction). The flow path 47-2 discharging the ink (liquid) from the return path 47-1 is provided in the inside of the projection portion of the plate 47.

The flow path 47-2 communicates with the side flow path 51 described later in the Y direction. The flow path 47-2 discharges the ink having passed through the side flow path 51 and the return path 47-1 to the outside on the upper end side of the plate 47.

The material for the plate 47 can be a ceramic, a metal, a plastic, a glass material, or the like, for example.

The spacer plate 49 has side surfaces 49*a* and 49*b*, an upper end surface 49*d* as one surface, and a lower end surface 49*c* as the other surface. The actuator plate 41 is arranged on the upper end surface 49*d* (one surface) of the spacer plate 49.

The spacer plate 49 is provided on the lower end surface 45*a* of the cover plate 45, the lower end surface 47*a* of the plate 47, and the lower end surface 41*d* of the actuator plate 41. The nozzle plate 53 with a plurality of nozzle holes 53A is joined to the lower end surface 49*c* (the other surface) of the spacer plate 49 arranged on the cover plate 45 and the plate 47.

The thickness of the spacer plate 49 (the thickness of the side flow path 51 in the depth direction) provided on the cover plate 45 and the plate 47 is larger than the thickness of the spacer plate 49 provided on the lower end surface 41*d* of the actuator plate 41.

Accordingly, it is possible to arrange the side flow path 51 between the spacer plate 49 provided on the lower end surface 41*d* of the actuator plate 41 and the nozzle plate 53, which communicates with the ejection grooves 41-1, the return path 47-1, and the nozzle holes 53A of the nozzle plate 53 and is partly defined by the spacer plate 49.

The side flow path 51 extends along the horizontal direction (direction of a plane orthogonal to the Z direction) and communicates with the plurality of ejection grooves 41-1.

In addition, the circulation channel 54 in which the ink circulates includes the ejection grooves 41-1, the return path 47-1, and the side flow path 51. The return path 47-1 is arranged on the surface of the actuator plate 41 opposite to the surface on which the ejection grooves 41-1 are positioned and discharges the ink from the side flow path 51. The return path 47-1 and the ejection grooves 41-1 extend along the Z direction (vertical direction).

The spacer plate 49 provided on the lower end surface 41*d* of the actuator plate 41 constitutes an air bubble retention suppression unit 52 that suppresses retention of air bubbles in the side flow path 51 between the nozzle holes 53A and the ejection grooves 41-1.

That is, the air bubble retention suppression unit 52 is arranged above the nozzle holes 53A and opposed to the nozzle holes 53A.

The air bubble retention suppression unit 52 has a horizontal surface 52*a* and an inclined surface 52*b* that define part of the side flow path 51 on the lower end side.

By defining part of the side flow path 51 using the spacer plate 49 as described above, it is possible to simplify the manufacturing process of the actuator plate 41 as compared to the case where the air bubble retention suppression unit 52 is formed on the actuator plate 41 to define part of the side flow path 51. That is, it is possible to simplify the structure of the actuator plate 41.

The horizontal surface 52*a* is a surface along the horizontal direction (the direction of a plane orthogonal to the Z direction). The horizontal surface 52*a* is arranged at the entry side of the side flow path 51 (in other words, the ejection groove 41-1 side).

The inclined surface 52*b* is a surface inclined with respect to the horizontal direction. The inclined surface 52*b* is arranged adjacent to the horizontal surface 52*a* in the direction of ink flow.

The inclined surface 52*b* is configured to widen the side flow path 51 (in other words, widen the flow path cross section area of the side flow path 51 when the side flow path 51 is sectioned by a plane orthogonal to the ink flow) in the direction from the horizontal surface 52*a* toward the exit side of the side flow path 51 (in other words, the return path 47-1 side).

Inclination angle θ1 of the inclined surface 52*b* with respect to the horizontal direction is preferably 5° or more, for example.

The horizontal surface 52*a* and the inclined surface 52*b* can be formed by the use of a dicing blade, for example.

A boundary position D between the horizontal surface 52*a* and the inclined surface 52*b* is preferably arranged nearer the entry side of the side flow path 51 than a central position C of the nozzle hole 53A.

By arranging the boundary position D between the horizontal surface 52*a* and the inclined surface 52*b* nearer the entry side of the side flow path 51 than the central position C of the nozzle hole 53A, it is possible to separate the horizontal surface 52*a* from the central position C of the nozzle hole 53A and arrange the inclined surface 52*b* immediately above the nozzle hole 53A.

In addition, by including the inclined surface 52*b* that widens the side flow path 51 in the direction from the horizontal surface 52*a* arranged nearer the ejection groove 41-1 side than the boundary position D toward the exit side of the side flow path 51-1, it is possible to, even when air bubbles stick to the inclined surface 52*b*, move the air bubbles along the inclined surface 52*b* and guide the air bubbles to the return path 47-1 by the buoyant force of the air bubbles and the flow of the ink from the entry to exit sides of the side flow path 51.

Accordingly, it is possible to suppress retention of air bubbles in the side flow path 51 positioned between the nozzle holes 53A and the ejection grooves 41-1, thereby suppressing accumulation of the air bubbles in the nozzle holes 53A.

The air bubbles sticking to the horizontal surface 52*a* and the inclined surface 52*b* exposed to the side flow path 51 include the air bubbles included in the ink flowing into the ejection grooves 41-1, the air bubbles sticking once to the nozzle holes 53A and their surroundings and then moving to the horizontal surface 52*a* and the inclined surface 52*b*, and the like. These air bubbles can be guided to the return path 47-1.

Further, providing the air bubble retention suppression unit 52 on the spacer plate 49 facilitates the formation of the air bubble retention suppression unit 52 as compared to the case where the air bubble retention suppression unit 52 is formed on the actuator plate 41.

The nozzle plate 53 is joined to the lower end surface 49*c* of the spacer plate 49. The nozzle plate 53 is a plate-like member extending in the Y direction. The nozzle plate 53 has the plurality of nozzle hole 53A communicating with the side flow path 51, the inner surface 53*a* to be joined to the spacer plate 49, and an ink jet surface 53*b* arranged on the surface opposite to the inner surface 53*a*.

The plurality of nozzle holes 53A is arranged at predetermined intervals in the Y direction corresponding to the ejection grooves 41-1 arranged in the Y direction. The non-ejection grooves 41-2 have no nozzle hole.

The material for the nozzle plate 53 can be a polyimide film or any other plastic film, or a metallic sheet, or the like, for example.

The common electrodes 55 are formed in a depth direction from the upper ends of the ejection grooves 41-1 to almost half of depth of the ejection grooves 41-1. The common electrodes 55 are formed in a band-like shape in a longitudinal direction in the ejection grooves 41-1 from the lower end surface 41*d* of the actuator plate 41 to an inclined surface from which the grooves rise up to the side surface 41*a* of the actuator plate 41. The common electrodes 55 are formed so as not to lie on the spacer plate 49. The common electrodes 55 are set at a GND potential to apply a drive voltage to the active electrodes.

The common electrodes 55 are formed on both inner side surfaces of the ejection grooves 41-1. The common electrodes 55 formed on the both inner side surfaces of the ejection grooves 41-1 are made electrically conductive by bridge electrodes formed on the inclined surface (electrodes formed by oblique evaporation concurrently with the formation of drive electrodes).

The bridge electrodes and the common electrodes 55 formed on the both inner side surfaces of the ejection grooves 41-1 reach the side surface 41*a* at the highest position on the inclined surface and connect electrically to the common terminal 56 formed on the side surface 41*a* of the actuator plate 41.

The common terminal 56 is provided on the side surface 41*a* of the actuator plate 41 positioned between the ejection grooves 41-1 and the individual terminals 57.

The common terminal 56 is electrically connected to the drive electrodes formed on the both side surfaces of the ejection grooves 41-1.

The individual terminals 57 are provided on the side surface 41*a* of the actuator plate 41 positioned nearer the upper end surface 41*c* than the formation position of the common terminal 56. The individual terminals 57 are formed across the ejection grooves 41-1.

The individual terminals 57 connect electrically the drive electrodes positioned on the two side surfaces of the two non-ejection grooves 41-2 on the ejection grooves 41-1 side sandwiching the ejection groove 41-1.

When a drive signal is applied to the common terminal 56 and the individual terminals 57, the two side walls between the ejection groove 41-1 and the two non-ejection grooves 41-2 sandwiching the ejection groove 41-1 deform in shear mode to change the capacity of the ejection groove 41-1.

The active electrodes (not illustrated) are formed in a depth direction from the upper end of the non-ejection grooves 41-2 to almost half of depth of the grooves as the common electrodes 55 are. The active electrodes are formed in a belt-like shape in a longitudinal direction from the lower end surface 41*d* to the upper end surface 41*c* of the actuator plate 41 in the non-ejection grooves 41-2. The active electrodes are provided so as not to lie on the spacer plate 49.

The active electrodes are formed on the both inner side surfaces of the non-ejection grooves 41-2. The two active electrodes opposed to each other in the one non-ejection groove 41-2 are electrically separated. Drive voltages for driving the different ejection grooves 41-1 are applied to the two opposed active electrodes. The non-ejection grooves 41-2 have bottom surfaces with a constant depth that is larger than the depth in which the conductive material is filmed by oblique evaporation. Accordingly, the opposed active electrodes are not electrically conductive via the bottoms of the non-ejection grooves 41-2.

The active electrodes in the non-ejection grooves 41-2 on the ejection groove 41-1 side sandwiching the one ejection groove 41-1 are electrically connected by the individual terminals 57.

Next, the operation of the liquid jet head 5 illustrated in FIG. 1 will be explained.

First, an ink is supplied to the upper liquid chamber 45A, and then the ink enters into the ejection grooves 41-1 and flows toward the inner surface 53*a* of the nozzle plate 53.

Then, the ink flows from the ejection grooves 41-1 into the side flow path 51 and flows out in a predetermined reference direction parallel to the Y direction.

Then, in this state, drive signals are applied to the common terminal and the individual terminals to deform the two side walls sandwiching the ejection grooves 41-1 in shear mode.

Specifically, first, the capacities of the ejection grooves 41-1 are instantaneously increased to draw the ink from the upper liquid chamber 45A, and then the capacities of the ejection grooves 41-1 are instantaneously returned to the original level. Accordingly, pressure wave is generated on the ink in the ejection grooves 41-1 to eject ink droplets from the nozzle holes 53A.

According to the liquid jet head 5 in the first embodiment, by including the air bubble retention suppression unit 52 that is formed from the spacer plate 49 and defines part of the side flow path 51, it is possible to simplify the manufacturing process of the actuator plate 41 as compared to the case where the air bubble retention suppression unit 52 is formed on the actuator plate 41.

In addition, by arranging the boundary position D between the horizontal surface 52*a* and the inclined surface 52*b* constituting the air bubble retention suppression unit 52 nearer the entry side of the side flow path 51 than the central position C of the nozzle hole 53A, it is possible to arrange the inclined surface 52*b* of the air bubble retention suppression unit 52 effective in suppressing retention of air bubbles above the nozzle holes 53A.

In addition, even when air bubbles flowing in the side flow path 51 stick to the inclined surface 52*b*, it is possible to move the air bubbles along the inclined surface 52*b* and guide the air bubbles to the return path 47-1 by the buoyant force of the air bubbles and the flow of the ink from the entry side to the exit side of the side flow path 51.

Accordingly, it is possible to suppress retention of the air bubbles in the side flow path 51 positioned between the nozzle holes 53A and the ejection grooves 41-1, thereby suppressing accumulation of the air bubbles in the nozzle holes 53A.

Further, the liquid jet head 5 is driven by applying a voltage to the ejection grooves 41-1 to increase the ink pressure and eject the ink from the nozzle holes 53A. By arranging the horizontal surface 52*a* nearer the ejection grooves 41-1 than the boundary position D, it is possible to suppress retention of the air bubbles on the horizontal surface 52*a*.

In addition, according to the liquid jet apparatus 1 including the thus configured liquid jet head 5 according to the first embodiment, it is possible to obtain the same advantageous effects as those of the liquid jet head 5 described above, and eject ink droplets from the nozzle holes to produce prints in a favorable state.

Second Embodiment

Figure 6:
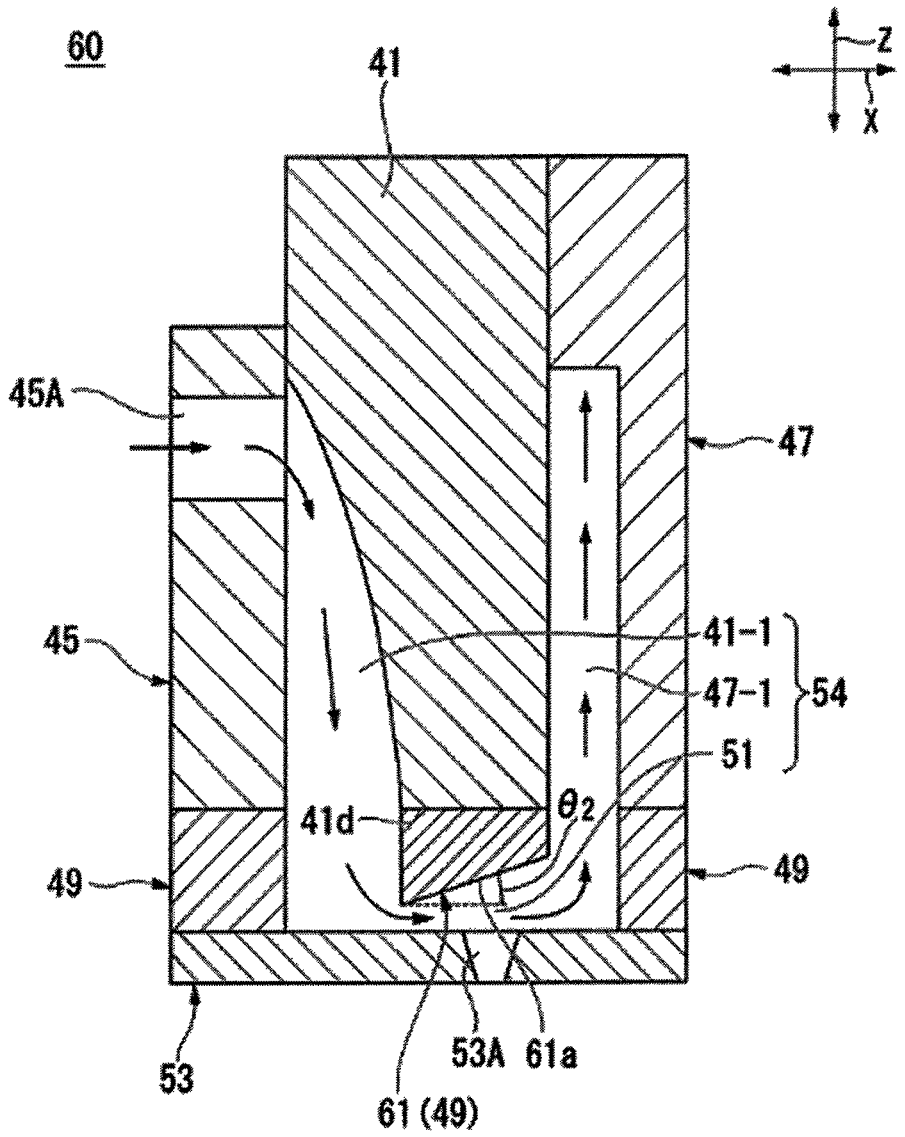
FIG. 6 is a cross-sectional view of main components of a head chip according to a second embodiment of the present invention.

FIG. 6 is a cross-sectional view of main components of a head chip according to a second embodiment of the present invention. FIG. 6 is a cross-sectional view of a head chip 60 in the second embodiment sectioned to pass through the ejection groove 41-1 as with FIG. 5 described above. In FIG. 6, the same components as those of the head chip 26 illustrated in FIG. 5 are given the same reference signs as those of the head chip 26. FIG. 6 does not illustrate the common electrode 55, the common terminal 56, the individual terminal 57 illustrated in FIG. 5 and the active electrode constituting the head chip 60.

Referring to FIG. 6, the head chip 60 of the second embodiment is configured in the same manner as the head chip 26 described above in relation to the first embodiment except in including an air bubble retention suppression unit 61 instead of the air bubble retention suppression unit 52 constituting the head chip 26 and having a side flow path 51 different in shape from the side flow path 51 illustrated in FIG. 5.

The air bubble retention suppression unit 61 is formed from a spacer plate 49 and is provided on a lower end surface 41*d* of an actuator plate 41 opposed to nozzle holes 53A.

The air bubble retention suppression unit 61 has an inclined surface 61*a* that inclines with respect to the horizontal direction and widens the flow path cross section area of the side flow path 51 in a direction from the entry side of the side flow path 51 to the exit side (the return path 47-1 side) of the side flow path 51.

The inclined surface 61*a* defines part of the side flow path 51. The inclined surface 61*a* is opposed to the nozzle holes 53A. Inclination angle θ2 of the inclined surface 61*a* with respect to the horizontal direction can fall within the same range as that of the inclination angle θ1 as described above.

According to the head chip 60 of the second embodiment, by including the inclined surface 61*a* that inclines with respect to the horizontal direction and widens the flow path cross section area of the side flow path 51 in the direction from the entry side of the side flow path 51 toward the exit side of the side flow path 51, it is possible to, even when air bubbles stick to the inclined surface 61*a* (for example, the air bubbles included in the ink flowing into the ejection grooves 41-1, the air bubbles sticking once to the nozzle holes 53A and their surroundings and then moving from there, and the like), move the air bubbles along the inclined surface 61*a* and guide the air bubbles to the return path 47-1 by the buoyant force of the air bubbles and the flow of the ink flowing from the entry to exit sides of the side flow path.

Accordingly, it is possible to suppress retention of the air bubbles in the side flow path 51 positioned between the nozzle holes 53A and the ejection grooves 41-1, thereby suppressing accumulation of the air bubbles in the nozzle holes 53A.

Further, providing the air bubble retention suppression unit 61 on the spacer plate 49 facilitates the formation of the air bubble retention suppression unit 61 as compared to the case where the air bubble retention suppression unit 61 is formed on the actuator plate 41.

The liquid jet head and the liquid jet apparatus including the thus configured head chip 60 as a constituent element can provide the same advantageous effects as those of the head chip 60 in the second embodiment.

Third Embodiment

Figure 7:
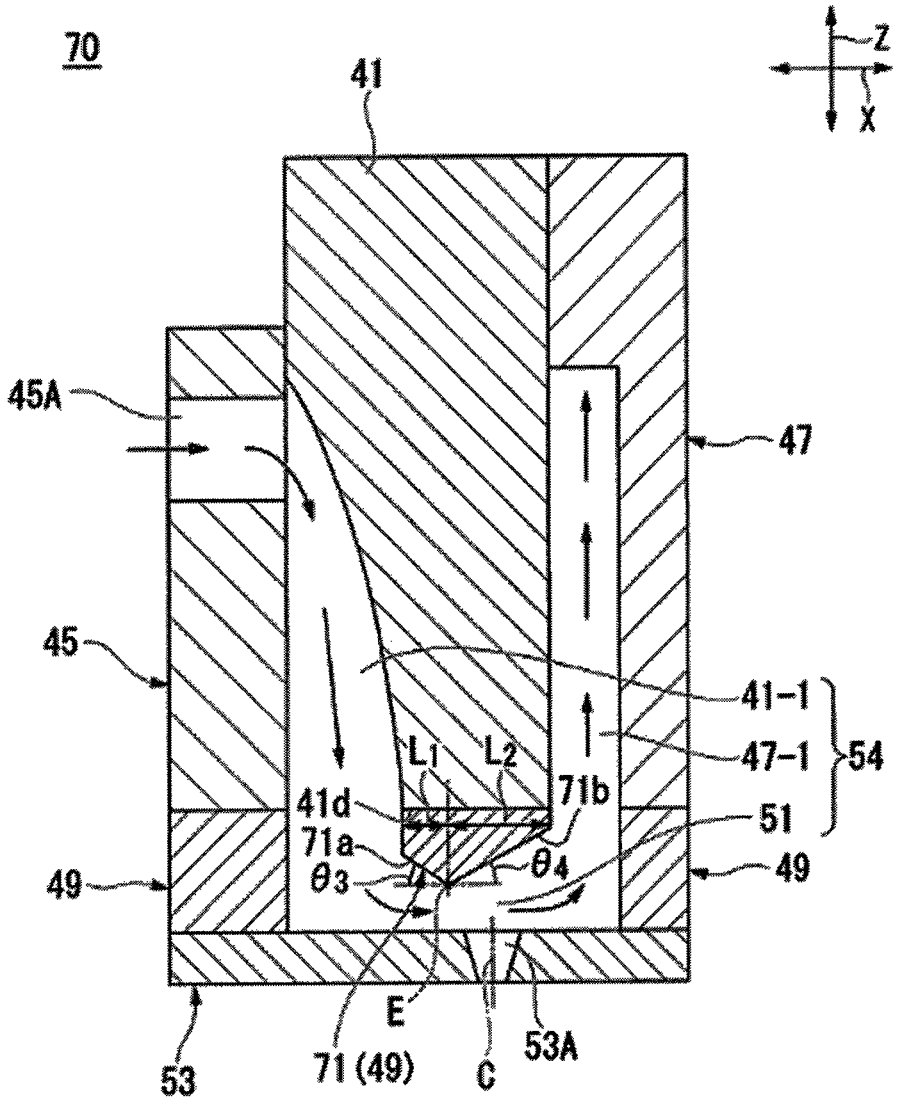
FIG. 7 is a cross-sectional view of main components of a head chip according to a third embodiment of the present invention.

FIG. 7 is a cross-sectional view of main components of a head chip according to a third embodiment of the present invention. FIG. 7 is a cross-sectional view of a head chip 70 in the third embodiment sectioned to pass through the ejection groove 41-1 as with FIG. 5 described above. In FIG. 7, the same components as those of the head chip 26 illustrated in FIG. 5 are given the same reference signs as those of the head chip 26. FIG. 7 does not illustrate the common electrode 55, the common terminal 56, and the individual terminal 57 illustrated in FIG. 5 and the active electrode constituting the head chip 70.

Referring to FIG. 7, the head chip 70 of the third embodiment is configured in the same manner as the head chip 26 described above in relation to the first embodiment except in including an air bubble retention suppression unit 71 instead of the air bubble retention suppression unit 52 constituting the head chip 26 and having a side flow path 51 different in shape from the side flow path 51 illustrated in FIG. 5.

The air bubble retention suppression unit 71 is formed from a spacer plate 49 and is provided on a lower end surface 41*d* of an actuator plate 41 opposed to nozzle holes 53A.

The air bubble retention suppression unit 71 has first and second inclined surfaces 71*a* and 71*b* that serve as lower end surfaces defining part of the side flow path 51.

The first inclined surface 71*a* is arranged nearer the ejection groove 41-1 than a boundary position E. The first inclined surface 71*a* is inclined with respect to the horizontal direction (the direction of a plane orthogonal to the Z direction) to widen the side flow path 51 in a direction from the nozzle hole 53A toward the entry side of the side flow path 51.

Inclination angle θ3 of the first inclined surface 71*a* with respect to the horizontal direction can be 5° or more, for example.

The flow path cross section area of the side flow path 51 positioned under the first inclined surface 71*a* (the flow path cross section area of the flow path sectioned by a plane orthogonal to the direction of ink flow) is preferably smaller than the flow path cross section area of the ejection groove 41-1 (the flow path cross section area of the flow path sectioned by the plane orthogonal to the direction of ink flow) positioned near the side flow path 51.

According to this configuration, the flow velocity of the ink flowing in the side flow path 51 positioned under the first inclined surface 71*a* can be increased to move the air bubbles sticking to the first inclined surface 71*a* from the upstream to downstream sides of the first inclined surface 71*a*.

The second inclined surface 71*b* is adjacent to the first inclined surface 71*a* and is arranged nearer the return path 47-1 than the boundary position E. The second inclined surface 71*b* is inclined with respect to the horizontal direction to widen the side flow path 51 in a direction from the nozzle hole 53A toward the exit side of the side flow path 51.

Inclination angle θ4 of the second inclined surface 71*b* with respect to the horizontal plane can be 5° or more, for example.

The boundary position E between the first inclined surface 71*a* and the second inclined surface 71*b* are preferably arranged nearer the entry side of the side flow path 51 than the central position C of the nozzle hole 53A.

According to the head chip 70 in the third embodiment, by arranging the boundary position E between the first inclined surface 71*a* and the second inclined surface 71*b* nearer the entry side of the side flow path 51 than the central position C of the nozzle hole 53A, it is possible to suppress retention of air bubbles immediately above the nozzle hole 53A. For example, even when air bubbles move to the first inclined surface 71*a*, it is possible to move the air bubbles from the first inclined surface 71*a* toward the second inclined surface 71*b* by the flow velocity of the ink. In addition, in this case, when the air bubbles do not go beyond the boundary position E, the air bubbles rise from the boundary position E toward the ejection groove 41-1 by the buoyant force of the air bubbles, thereby making it possible to suppress retention of the air bubbles immediately above the nozzle hole 53A.

In addition, since the air bubble retention suppression unit 71 includes the second inclined surface 71*b* that widens the side flow path 51 in the direction from the nozzle holes 53A toward the exit side of the side flow path 51 and the boundary position E between the first inclined surface 71*a* and the second inclined surface 71*b* nearer the entry side of the side flow path 51 than the central position C of the nozzle hole 53A, it is possible to, even when air bubbles stick to the second inclined surface 71*b*, move the air bubbles along the second inclined surface 71*b* and guide the air bubbles to the return path 47-1 by the buoyant force of the air bubbles and the flow velocity of the ink flowing from the entry to exit sides of the side flow path 51.

Accordingly, it is possible to suppress retention of the air bubbles in the side flow path 51 positioned between the nozzle holes 53A and the ejection grooves 41-1, thereby suppressing accumulation of the air bubbles in the nozzle holes 53A.

Further, providing the air bubble retention suppression unit 71 on the spacer plate 49 makes it possible to facilitate the formation of the air bubble retention suppression unit 71 as compared to the case where the air bubble retention suppression unit 71 is formed on the actuator plate 41 and simplify the configuration of the actuator plate 41.

The liquid jet head and the liquid jet apparatus including the thus configured head chip 70 as a constituent element can provide the same advantageous effects as those of the head chip 70 described above.

In addition, in the third embodiment, an X-direction length L1 in which the first inclined surface 71*a* is formed is shorter than an X-direction length L2 in which the second inclined surface 71*b* is formed as an example. Alternatively, the length L1 and the length L2 may be equal or the length L2 may be shorter than the length L1 as far as the boundary position E between the first inclined surface 71*a* and the second inclined surface 71*b* is arranged nearer the entry side of the side flow path 51 than the central position C of the nozzle hole 53A.

Fourth Embodiment

Figure 8:
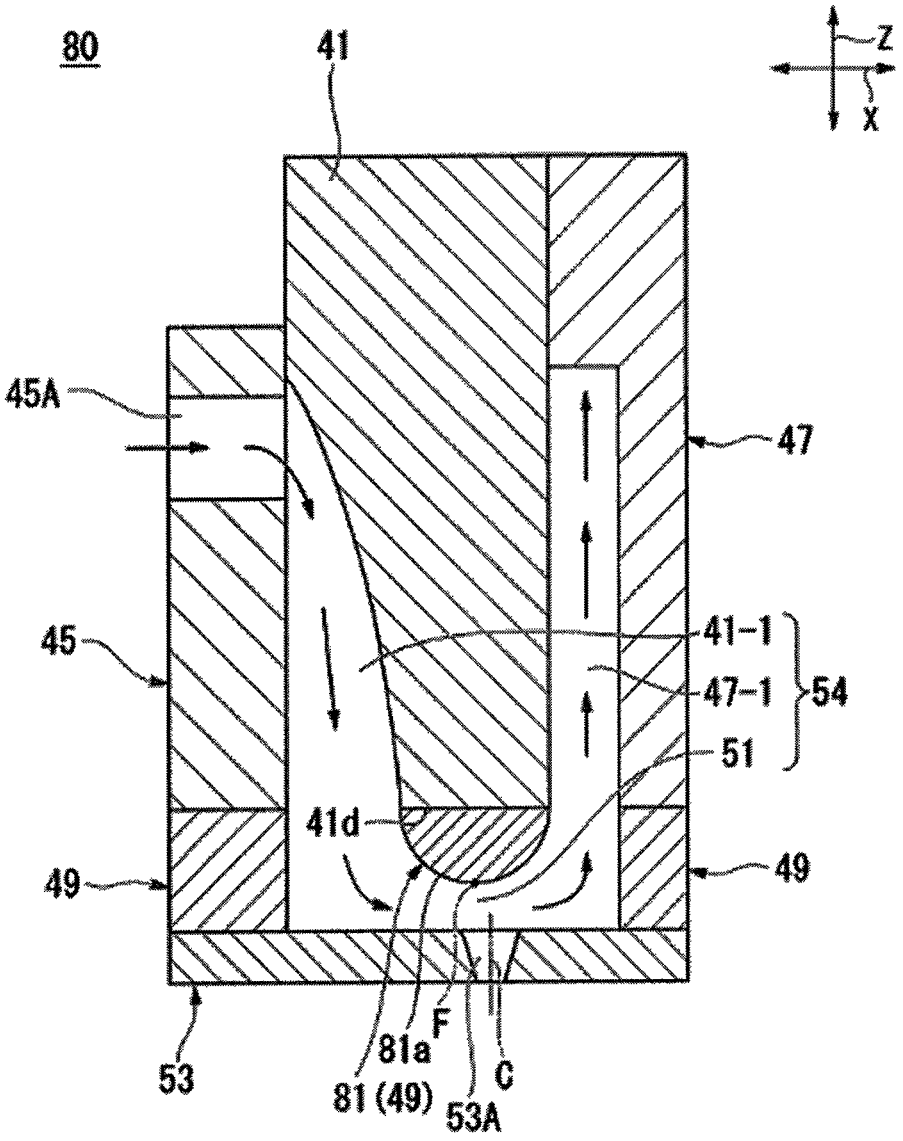
FIG. 8 is a cross-sectional view of main components of a head chip according to a fourth embodiment of the present invention.

FIG. 8 is a cross-sectional view of main components of a head chip according to a fourth embodiment of the present invention. FIG. 8 is a cross-sectional view of a head chip 80 in the fourth embodiment sectioned to pass through the ejection groove 41-1 as with FIG. 5 described above. In FIG. 8, the same components as those of the head chip 26 illustrated in FIG. 5 are given the same reference signs as those of the head chip 26. FIG. 8 does not illustrate the common electrode 55, the common terminal 56, and the individual terminal 57 illustrated in FIG. 5 and the active electrode constituting the head chip 80.

Referring to FIG. 8, the head chip 80 of the fourth embodiment is configured in the same manner as the head chip 26 described above in relation to the first embodiment except in including an air bubble retention suppression unit 81 instead of the air bubble retention suppression unit 52 constituting the head chip 26 and having a side flow path 51 different in shape from the side flow path 51 illustrated in FIG. 5.

The air bubble retention suppression unit 81 is formed from a spacer plate 49 and is provided on a lower end surface 41*d* of an actuator plate 41 opposed to nozzle holes 53A.

The air bubble retention suppression unit 81 has a curved surface 81*a* that protrudes in a direction toward the nozzle plate 53 and defines part of the side flow path 51. Lowest point F on the curved surface 81*a* is arranged nearer the entry side of the side flow path 51 than the central position C of the nozzle hole 53A.

According to the head chip 80 in the fourth embodiment, by providing the air bubble retention suppression unit 81 with the curved surface 81*a* protruding toward the nozzle plate 53 and arranging the lowest point F on the curved surface 81*a* nearer the entry side of the side flow path 51 than the central position C of the nozzle hole 53A, it is possible to, even when air bubbles stick to the curved surface 81*a* arranged nearer the ejection groove 41-1 than the lowest point F, move the air bubbles to the curved surface 81*a* positioned nearer the return path 47-1 than the lowest point F by the flow of the ink into the ejection grooves 41-1.

Then, it is possible to move the air bubbles sticking to the curved surface 81*a* positioned nearer the return path 47-1 than the lowest point F along the curved surface 81*a* positioned nearer the return path 47-1 than the lowest point F and guide the air bubbles to the return path 47-1 by the buoyant force of the air bubbles and the flow of the ink from the entry to exit sides of the side flow path 51.

Accordingly, it is possible to suppress retention of the air bubbles in the side flow path 51 positioned between the nozzle holes 53A and the ejection grooves 41-1, thereby suppressing accumulation of the air bubbles in the nozzle holes 53A.

Further, providing the air bubble retention suppression unit 81 on the spacer plate 49 makes it possible to facilitate the formation of the air bubble retention suppression unit 81 as compared to the case where the air bubble retention suppression unit 81 is formed on the actuator plate 41.

The liquid jet head and the liquid jet apparatus including the thus configured head chip 80 as a constituent element can provide the same advantageous effects as those of the head chip 80 described above.

Fifth Embodiment

Figure 9:
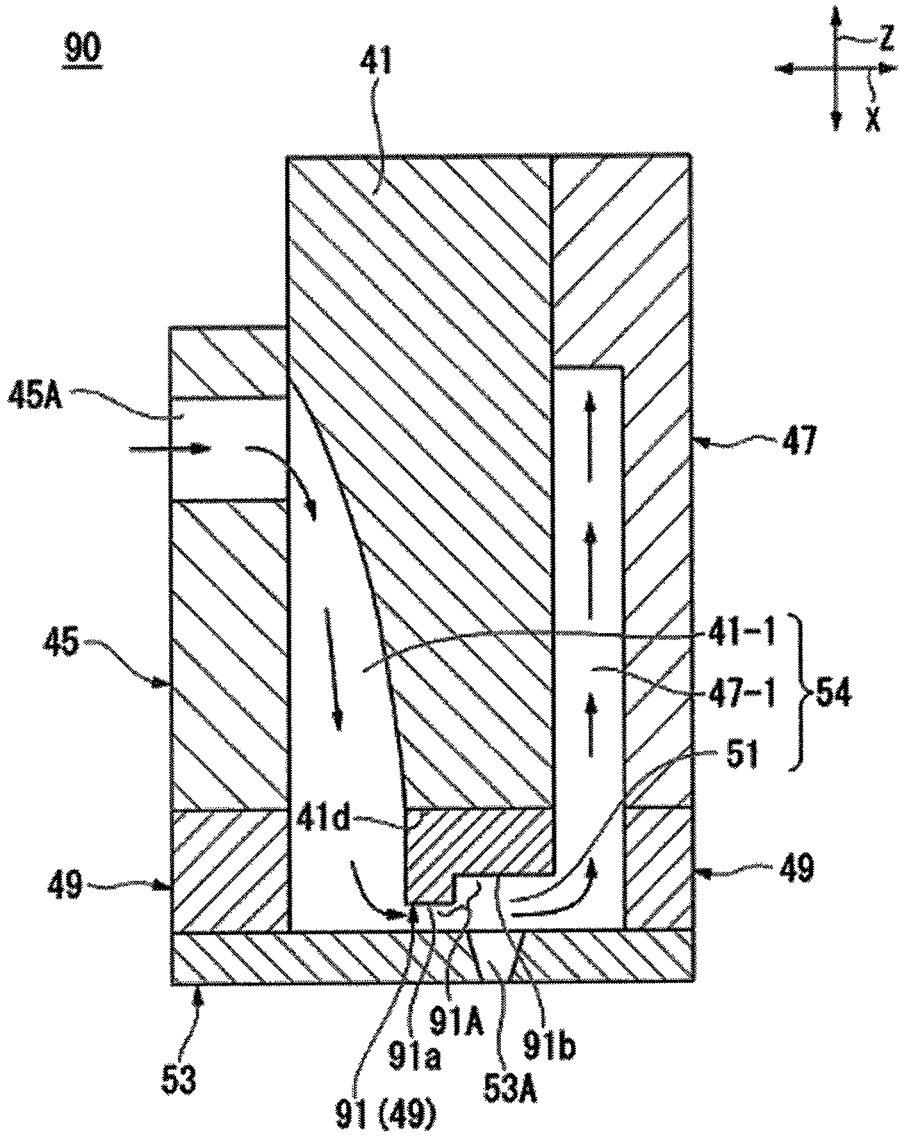
FIG. 9 is a cross-sectional view of main components of a head chip according to a fifth embodiment of the present invention.

FIG. 9 is a cross-sectional view of main components of a head chip according to a fifth embodiment of the present invention. FIG. 9 is a cross-sectional view of a head chip 90 in the fifth embodiment sectioned to pass through the ejection groove 41-1 as with FIG. 5 described above. In FIG. 9, the same components as those of the head chip 26 illustrated in FIG. 5 are given the same reference signs as those of the head chip 26. FIG. 9 does not illustrate the common electrode 55, the common terminal 56, and the individual terminal 57 illustrated in FIG. 5 and the active electrode constituting the head chip 90.

Referring to FIG. 9, the head chip 90 of the fifth embodiment is configured in the same manner as the head chip 26 described above in relation to the first embodiment except in including an air bubble retention suppression unit 91 instead of the air bubble retention suppression unit 52 constituting the head chip 26 and having a side flow path 51 different in shape from the side flow path 51 illustrated in FIG. 5.

The air bubble retention suppression unit 91 is formed from a spacer plate 49 and is provided on a lower end surface 41*d* of an actuator plate 41 opposed to nozzle holes 53A.

The air bubble retention suppression unit 91 has horizontal surfaces 91*a* and 91*b* parallel to the horizontal direction and a step portion 91A.

The horizontal surface 91*a* is arranged nearer the ejection groove 41-1 than the nozzle hole 53A and constitutes part of the lower end surface of the air bubble retention suppression unit 91. The horizontal surface 91*b* is arranged nearer the return path 47-1 side than the nozzle hole 53A and constitutes the remaining part of the lower end surface of the air bubble retention suppression unit 91. The horizontal surface 91*b* is arranged above the horizontal surface 91*a*.

The step portion 91A is formed between the horizontal surface 91*a* and the horizontal surface 91*b*. The step portion 91A widens the side flow path 51 in the direction from the entry side of the side flow path 51 toward the exit side of the side flow path 51. In other words, the flow path cross section area of the side flow path 51 (the flow path cross section area sectioned by the plane orthogonal to the direction of ink flow) positioned under the horizontal surface 91*a* is smaller than the flow path cross section of the side flow path 51 positioned under the horizontal surface 91*b*.

In addition, the flow path cross section area of the side flow path 51 positioned under the horizontal surface 91*a* is smaller than the flow path cross section area of the ejection groove 41-1 (the flow path cross section area sectioned by the plane orthogonal to the direction of ink flow) positioned in the vicinity of the side flow path 51.

With this configuration, it is possible to increase the flow velocity of the ink passing through the horizontal surface 91*a* and make it easy to flow the ink to the downstream side of the horizontal surface 91*a* (the horizontal surface 91*b* side).

According to the head chip 90 of the fifth embodiment, by including the air bubble retention suppression unit 91 that has the step portion 91A widening the side flow path 51 in the direction from the entry side of the side flow path 51 toward the exit side of the side flow path 51, it is possible to, even when air bubbles stick to the horizontal surfaces 91*a* and 91*b* and the step portion 91A, move the air bubbles in the direction toward the return path 47-1 and guide the air bubbles to the return path 47-1 by the buoyant force of the air bubbles and the flow of the ink from the entry to exit sides of the side flow path 51.

Accordingly, it is possible to suppress retention of the air bubbles in the side flow path 51 positioned between the nozzle holes 53A and the ejection grooves 41-1, thereby suppressing accumulation of the air bubbles in the nozzle holes 53A.

Further, providing the air bubble retention suppression unit 91 on the spacer plate 49 makes it possible to facilitate the formation of the air bubble retention suppression unit 91 and simplify the configuration of the actuator plate 41 as compared to the case where the air bubble retention suppression unit 91 is formed on the actuator plate 41.

The liquid jet head and the liquid jet apparatus including the thus configured head chip 90 as a constituent element can provide the same advantageous effects as those of the head chip 90 described above.

In addition, in the fifth embodiment, when the difference between the breadth of the side flow path 51 positioned under the horizontal surface 91*a* and the breadth of the ejection groove 41-1 positioned in the vicinity of the side flow path 51 is small, it is difficult to increase the flow velocity of the ink flowing under the horizontal surface 91*a*. In such a case, however, the air bubbles existing in the side flow path 51 can be moved to the return path 47-1 by the buoyant force of the air bubbles and the flow of the ink.

In the fifth embodiment, the one step portion 91A is provided as an example. However, the present invention is not limited to the structure illustrated in FIG. 9, but the number of the step portion(s) 91A that widen the side flow path 51 in the direction from the entry to exit sides of the side flow path 51 may be at least one or more.

For example, providing a plurality of step portions 91A can provide the same advantageous effects as those in the case where the inclined surface is provided.

In the fifth embodiment, the step portion 91A is provided between the two horizontal surfaces 91*a* and 91*b* arranged at different heights. Alternatively, instead of the horizontal surface 91*b* illustrated in FIG. 9, the inclined surface 52*b* illustrated in FIG. 5 may be used to provide the step portion 91A between the horizontal surface 91*a* and the inclined surface 52*b*, for example.

In this case, it is possible to utilize effectively the buoyant force of the air bubbles sticking to the inclined surface 52*b*. This facilitates movement of the air bubbles positioned in the side flow path 51 to the return path 47-1.

In addition, for example, instead of the two horizontal surfaces 91*a* and 91*b* illustrated in FIG. 9, two inclined surfaces (for example, the inclined surfaces 52*b* illustrated in FIG. 5) may be provided and the step portion 91A may be arranged between the two inclined surface.

Sixth Embodiment

Figure 10:
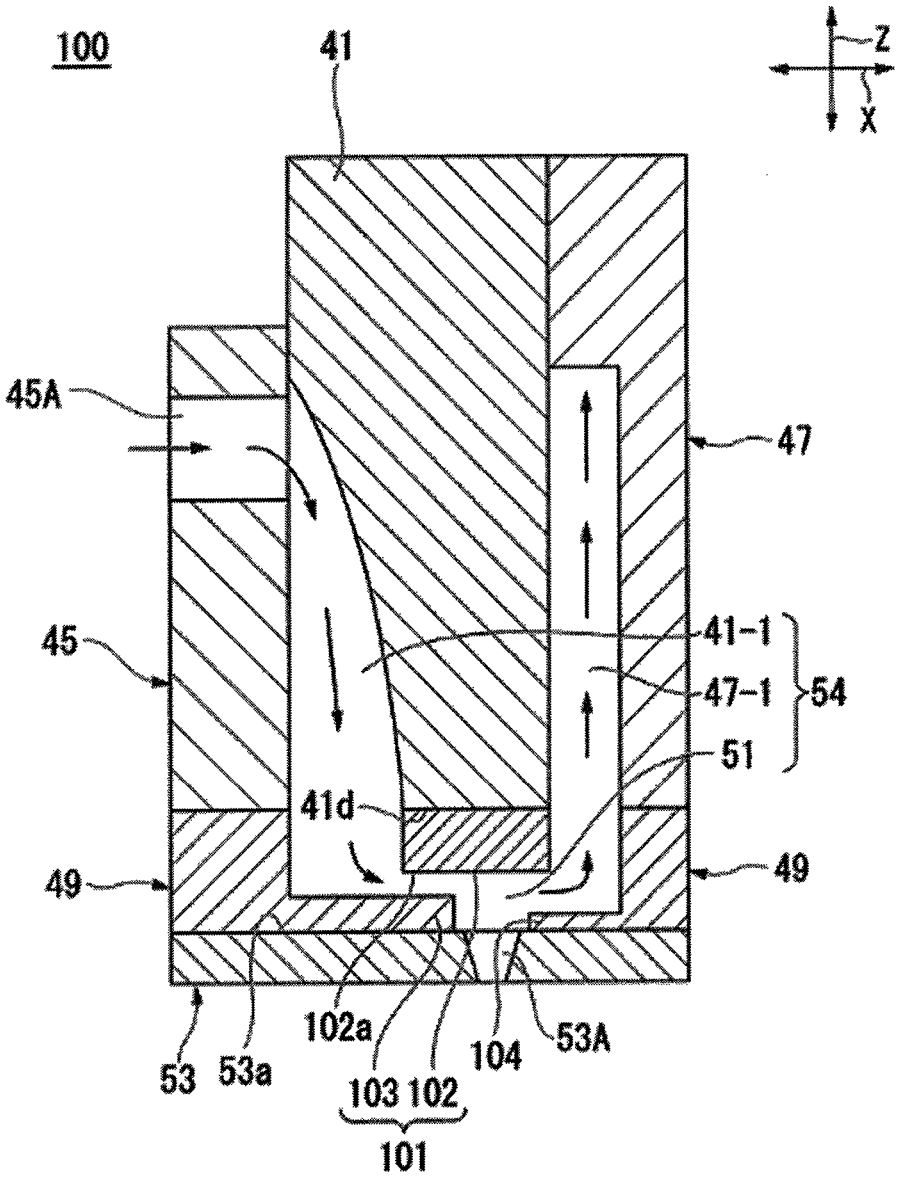
FIG. 10 is a cross-sectional view of main components of a head chip according to a sixth embodiment of the present invention.

FIG. 10 is a cross-sectional view of main components of a head chip according to a sixth embodiment of the present invention. FIG. 10 is a cross-sectional view of a head chip 100 in the sixth embodiment sectioned to pass through the ejection groove 41-1 as with FIG. 5 described above. In FIG. 10, the same components as those of the head chip 26 illustrated in FIG. 5 are given the same reference signs as those of the head chip 26. FIG. 10 does not illustrate the common electrode 55, the common terminal 56, and the individual terminal 57 illustrated in FIG. 5 and the active electrode constituting the head chip 100.

Referring to FIG. 10, the head chip 100 of the sixth embodiment is configured in the same manner as the head chip 26 described above in relation to the first embodiment except in including a flow velocity increase part 101 as a kind of the air bubble retention suppression unit and a second portion 104 instead of the air bubble retention suppression unit 52 constituting the head chip 26 and having a side flow path 51 different in shape from the side flow path 51 illustrated in FIG. 5.

The flow velocity increase part 101 has a protrusion portion 102 and a first portion 103.

The protrusion portion 102 is provided on a lower end surface 41*d* of an actuator plate 41 opposed to nozzle holes 53A. The protrusion portion 102 protrudes downward from the lower end surface 41*d*. The lower end surface of the protrusion portion 102 is a horizontal surface 102*a*. The protrusion portion 102 is formed from the spacer plate 49.

The first portion 103 is arranged on an inner surface 53*a* of a nozzle plate 53 positioned nearer the entry side of the side flow path 51 than the formation position of the nozzle hole 53A. The first portion 103 is opposed to the protrusion portion 102 under the protrusion portion 102. The first portion 103 is formed from the spacer plate 49.

The thus configured flow velocity increase part 101 is arranged at the entry side of the side flow path 51 and has the function of increasing the flow velocity of the ink more at the entry side of the side flow path 51 than the exit side of the side flow path 51.

The second portion 104 is arranged on the inner surface 53*a* of the nozzle plate 53 positioned nearer the exit side of the side flow path 51 than the formation position of the nozzle hole 53A. The second portion 104 is opposed to the protrusion portion 102 under the protrusion portion 102.

The thickness of the second portion 104 is made smaller than the thickness of the first portion 103. The second portion 104 is formed from the spacer plate 49.

Accordingly, the breadth of the side flow path 51 arranged between the first portion 103 and the protrusion portion 102 (in other words, the flow path cross section area of the side flow path 51 sectioned by the plane orthogonal to the direction of ink flow) is made smaller than the breadth of the side flow path 51 arranged between the second portion 104 and the protrusion portion 102.

In other words, the size of the flow path opening in the flow velocity increase part 101 is made smaller than the flow path opening at the exit side of the side flow path 51.

According to the head chip 100 of the sixth embodiment, by providing the spacer plate 49 with the flow velocity increase part 101 that makes the breadth of the side flow path 51 arranged between the first portion 103 and the protrusion portion 102 smaller than the breadth of the side flow path 51 arranged between the second portion 104 and the protrusion portion 102, it is possible to decrease the flow path cross section area of the side flow path 51 at the entry side of the side flow path 51 by the simple structure, and make the flow path cross section area at the exit side of the side flow path 51 larger than the flow path cross section area at the entry side of the side flow path 51.

In addition, by making the flow path cross section area at the exit side of the side flow path 51 larger than the flow path cross section area at the entry side of the side flow path 51, it is possible to increase the flow velocity at the entry side of the side flow path 51. As a result, it is possible to guide the air bubbles positioned in the side flow path 51 to the return path 47-1.

Accordingly, it is possible to suppress retention of the air bubbles in the side flow path 51 positioned between the nozzle holes 53A and the ejection grooves 41-1, thereby suppressing accumulation of the air bubbles in the nozzle holes 53A.

In addition, since the spacer plate 49 is processed to form the flow velocity increase part 101, the flow velocity increase part 101 can be easily formed as compared to the case where the actuator plate 41 is processed to form the flow velocity increase part 101 and the configuration of the actuator plate 41 can be simplified.

The liquid jet head and the liquid jet apparatus having the head chip 100 as a constituent element can provide the same advantageous effects as those of the head chip 100.

In the sixth embodiment, instead of the protrusion portion 102 constituting the flow velocity increase part 101, the air bubble retention suppression unit 52 illustrated in FIG. 5 or the air bubble retention suppression unit 91 illustrated in FIG. 9 may be used. In this case, it is possible to easily receive the effect of the buoyant force of the air bubbles and further suppress retention of the air bubbles in the side flow path 51.

Seventh Embodiment

Figure 11:
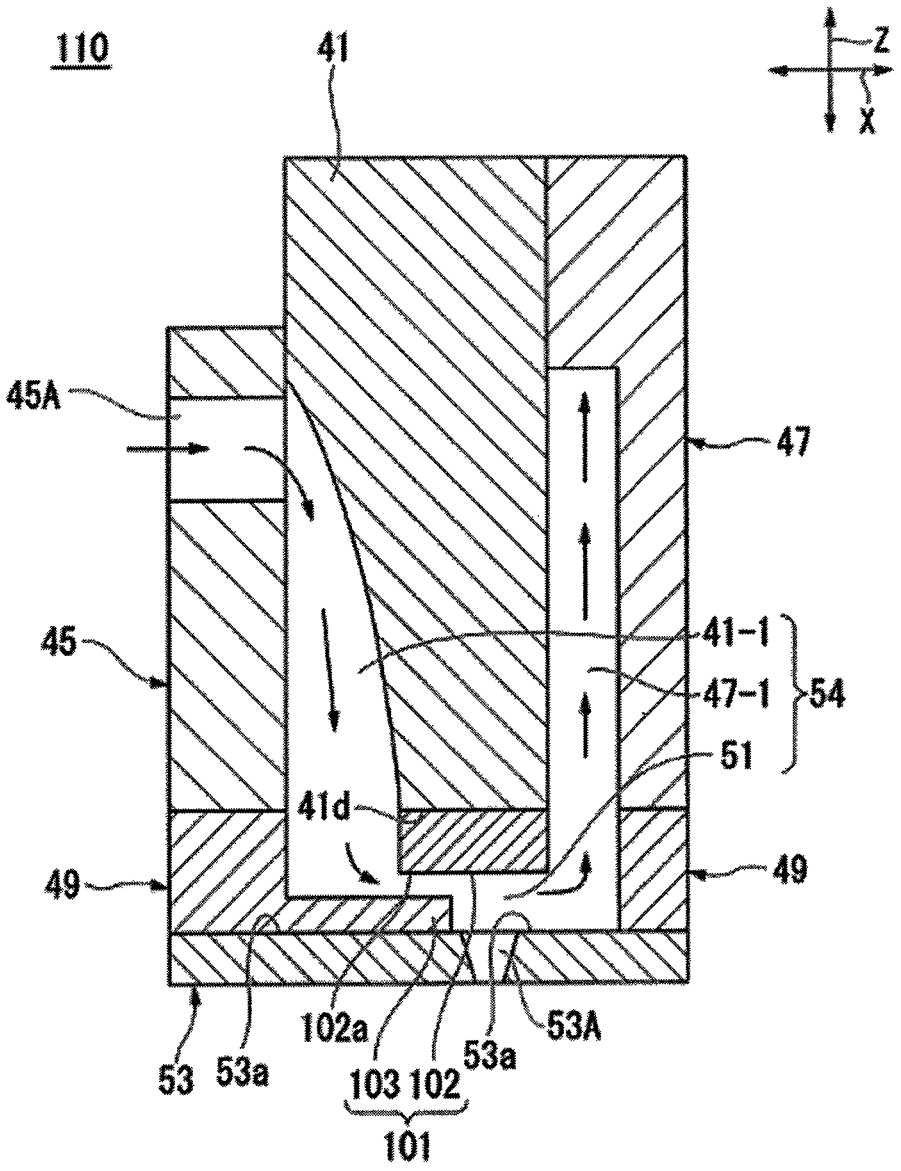
FIG. 11 is a cross-sectional view of main components of a head chip according to a seventh embodiment of the present invention.

FIG. 11 is a cross-sectional view of main components of a head chip according to a seventh embodiment of the present invention. FIG. 11 is a cross-sectional view of a head chip 110 in the seventh embodiment sectioned to pass through the ejection groove 41-1 as with FIG. 5 described above. In FIG. 11, the same components as those of the head chip 100 illustrated in FIG. 10 are given the same reference signs as those of the head chip 100. FIG. 11 does not illustrate the common electrode 55, the common terminal 56, and the individual terminal 57 illustrated in FIG. 5 and the active electrode constituting the head chip 110 illustrated in FIG. 5.

Referring to FIG. 11, the head chip 110 of the seventh embodiment is configured in the same manner as the head chip 100 of the sixth embodiment except in including an inner surface 53*a* of a nozzle plate 53 exposed from a side flow path 51 in the formation region of a second portion 104 instead of the second portion 104 constituting the head chip 100 of the sixth embodiment.

With this configuration, it is possible to increase the difference between the breadth of the side flow path 51 arranged between a first portion 103 and a protrusion portion 102 (in other words, the flow path cross section area of the side flow path 51 sectioned by the plane orthogonal to the direction of ink flow) and the breadth of the side flow path 51 positioned nearer the downstream side than the first portion 103.

According to the head chip 110 of the seventh embodiment, it is possible to decrease the flow path cross section area of the side flow path 51 at the entry side of the side flow path 51 by the simple structure, and make the flow path cross section area at the exit side of the side flow path 51 larger than the flow path cross section area at the entry side of the side flow path 51.

In addition, by making the flow path cross section area at the exit side of the side flow path 51 larger than the flow path cross section area at the entry side of the side flow path 51, it is possible to increase the flow velocity at the entry side of the side flow path 51. As a result, it is possible to guide the air bubbles positioned in the side flow path 51 to the return path 47-1.

Accordingly, it is possible to suppress retention of the air bubbles in the side flow path 51 positioned between the nozzle holes 53A and the ejection grooves 41-1, thereby suppressing accumulation of the air bubbles in the nozzle holes 53A.

In addition, since the spacer plate 49 is processed to form the protrusion portion 102 and the first portion 103, it is possible to form easily a flow velocity increase part 111 as compared to the case where the actuator plate 41 is processed to form the flow velocity increase part 111, and simplify the configuration of the actuator plate 41.

In the seventh embodiment, instead of the protrusion portion 102 constituting the flow velocity increase part 111, the air bubble retention suppression unit 52 illustrated in FIG. 5 or the air bubble retention suppression unit 91 illustrated in FIG. 9 may be used. In this case, it is possible to easily receive the effect of the buoyant force of the air bubbles and further suppress retention of the air bubbles in the side flow path 51.

The preferred embodiments of the present invention have been explained in detail so far. However, the present invention is not limited to the specific embodiments but can be modified and changed in various manners without deviation from the gist of the present invention described in the claims.

For example, in the first to seventh embodiments, the vertical circulation-type head chips are taken as examples of head chips. However, the present invention is also applicable to side shoot-type head chips.

What is claimed is:

1. A liquid jet head comprising:

an actuator plate having on one surface an ejection groove configured to eject liquid droplets;

a spacer plate having one surface on which the actuator plate is arranged and a side flow path communicating with the ejection groove;

a nozzle plate arranged on the other surface of the spacer plate and having a nozzle hole communicating with the side flow path;

a return path arranged on the surface of the actuator plate opposite to the one surface on which the ejection groove is positioned and configured to discharge liquid from the side flow path; and an air bubble retention suppression unit provided on the spacer plate and configured to suppress retention of air bubbles in the side flow path, wherein the ejection groove and the return path extend lengthwise in parallel with each other.

2. The liquid jet head according to claim 1, wherein the ejection groove and the return path extend along a vertical direction, the side flow path extends along a horizontal direction, the air bubble retention suppression unit includes, above the nozzle hole, a horizontal surface along the horizontal direction and an inclined surface configured to incline with respect to the horizontal surface and widen the side flow path in a direction from the horizontal surface toward an exit side of the side flow path, and a boundary position between the horizontal surface and the inclined surface is arranged nearer an entry side of the side flow path than a central position of the nozzle hole.

3. The liquid jet head according to claim 1, wherein the ejection groove and the return path extend along a vertical direction, the side flow path extends along a horizontal direction, and the air bubble retention suppression unit includes, above the nozzle hole, an inclined surface configured to incline with respect to the horizontal direction and widen the side flow path in a direction from an entry side of the side flow path toward an exit side of the side flow path.

4. The liquid jet head according to claim 1, wherein the ejection groove and the return path extend along a vertical direction, the side flow path extends along a horizontal direction, the air bubble retention suppression unit includes, above the nozzle hole, a first inclined surface configured to incline with respect to the horizontal direction and widen the side flow path in a direction from the nozzle hole toward an entry side of the side flow path and a second inclined surface configured to incline with respect to the horizontal direction and widen the side flow path in a direction from the nozzle hole toward an exit side of the side flow path, and a boundary position between the first inclined surface and the second inclined surface is arranged nearer the entry side of the side flow path than a central position of the nozzle hole.

5. The liquid jet head according to claim 1, wherein the ejection groove and the return path extend along a vertical direction, the side flow path extends along a horizontal direction, the air bubble retention suppression unit includes, above the nozzle hole, a curved surface configured to protrude in a direction toward the nozzle plate, and a lowest point on the curved surface is arranged nearer an entry side of the side flow path than a central position of the nozzle hole.

6. The liquid jet head according to claim 1, wherein the ejection groove and the return path extend along a vertical direction, the side flow path extends along a horizontal direction, and the air bubble retention suppression unit includes, above the nozzle hole, at least one step portion configured to widen the side flow path in a direction from an entry side of the side flow path toward an exit side of the side flow path.

7. The liquid jet head according to claim 1, wherein the air bubble retention suppression unit comprises a flow velocity increase part that is arranged at an entry side of the side flow path and increases a flow velocity of the liquid more at the entry side of the side flow path than an exit side of the side flow path, and the size of a flow path opening of the flow velocity increase part is smaller than the size of a flow path opening at the exit side of the side flow path.

8. The liquid jet head according to claim 7, wherein the flow velocity increase part includes a first portion arranged nearer the entry side of the side flow path than a formation position of the nozzle hole and formed from the spacer plate arranged on the nozzle plate, and by means of the first portion, the size of the flow path opening of the flow velocity increase part is smaller than the size of the flow path opening portion at the exit side of the side flow path.

9. A liquid jet apparatus comprising:

the liquid jet head according to claim 1; and a movement mechanism configured to relatively move the liquid jet head and a recording medium.

* * * * *